United States Patent [19]

Hait et al.

[11] Patent Number: 4,531,505

[45] Date of Patent: Jul. 30, 1985

[54] CONVERTIBLE COOKING UNIT WITH AN OVEN

[75] Inventors: Paul W. Hait, Los Gatos, Calif.; Dan Rohrer, Redmond, Oreg.

[73] Assignee: Pyromid, Inc., Saratoga, Calif.

[21] Appl. No.: 502,689

[22] Filed: Jun. 9, 1983

[51] Int. Cl.[3] ..... F24C 1/16

[52] U.S. Cl. ..... 126/9 R; 126/9 B; 126/25 R

[58] Field of Search ..... 126/9 R, 9 A, 9 B, 25 R, 126/25 A, 275 R, 1 R, 1 D, 1 E; 99/339, 340, 447, 450; 219/340, 454, 472–474

[56] References Cited

U.S. PATENT DOCUMENTS

| | | | |
|---|---|---|---|
| 756,330 | 4/1904 | Clergy et al. | 126/9 R |
| 1,090,045 | 5/1914 | Gladden | 126/215 |
| 1,238,142 | 8/1917 | Hitchcock | 126/9 R |
| 1,438,345 | 12/1922 | Tait et al. | 126/9 R |
| 1,651,818 | 12/1927 | Gorrell | 312/259 |
| 2,119,799 | 6/1938 | Sivey | 126/9 R |
| 2,237,081 | 4/1941 | Owens | 126/25 R |
| 2,424,665 | 7/1947 | Pope | 126/9 R |
| 2,469,885 | 5/1949 | Molla | 126/9 B X |
| 2,515,521 | 7/1950 | Loffredo | 126/9 |
| 2,576,750 | 11/1951 | Clark | 312/259 |
| 2,645,993 | 7/1953 | Voss | 126/9 R X |
| 3,027,887 | 4/1962 | Krohncke | 126/25 R |
| 3,327,698 | 6/1967 | Leslie | 126/25 |
| 3,384,066 | 5/1968 | Tufts | 126/9 R |
| 3,489,131 | 4/1968 | Richins | 126/9 |
| 3,494,349 | 2/1970 | Allen | 126/25 R |
| 3,664,321 | 5/1972 | Chiou | 126/9 R |
| 3,667,446 | 6/1972 | Morton | 126/9 R |
| 3,682,154 | 8/1972 | Mollere | 126/9 A |
| 3,765,397 | 10/1973 | Henderson | 126/25 R |
| 3,809,051 | 5/1974 | Giroux | 126/9 R |
| 3,880,139 | 4/1975 | Young | 126/9 R |
| 3,892,222 | 7/1975 | Darbo | 126/9 R |
| 3,915,144 | 10/1975 | Tomita | 126/9 R |
| 4,023,553 | 5/1977 | London et al. | 126/25 B |
| 4,037,580 | 7/1977 | Angelo | 126/25 R |
| 4,149,514 | 4/1979 | Latouf | 126/9 R |
| 4,203,427 | 5/1980 | Way, Jr. | 126/451 |
| 4,413,609 | 11/1983 | Tisdale | 126/25 R |

FOREIGN PATENT DOCUMENTS

| | | | |
|---|---|---|---|
| 136398 | 2/1950 | Australia | 126/9 R |
| 443796 | 8/1947 | Canada . | |
| 669321 | 8/1963 | Canada | 126/29 |
| 959365 | 12/1974 | Canada | 126/104 |
| 1372 | 1/1916 | United Kingdom | 126/9 R |

*Primary Examiner*—Margaret A. Focarino
*Attorney, Agent, or Firm*—Jack M. Wiseman

[57] ABSTRACT

A cooking unit includes an oven with a drawer. For storage and for transporting a folded truncated pyramidal firebox, a folded truncated pyramidal support member, a diffuser, a grill, a griddle, a windbreak and cover are disposed over the oven. The cover is releasably secured to the top of the oven and the folded truncated pyramidal firebox, the folded truncated pyramidal support member, the diffuser, the grill, the griddle and the windbreak are retained therebetween in a compact form. In use, the oven with the drawer may be employed as the base of the cooking unit or, in the alternative, the oven may be disposed above the extended truncated pyramidal firebox, the extended truncated pyramidal support member and the diffuser. In the alternate arrangement, the cover serves as the base for the cooking unit.

15 Claims, 17 Drawing Figures

CONVERTIBLE COOKING UNIT WITH AN OVEN

BACKGROUND OF THE INVENTION

Cooking units which are assembled for use and disassembled for enclosure in a container for facilitating the transportion thereof have been heretofore available. Such a cooking unit is disclosed in U.S. application, Ser. No. 378,111, filed on May 14, 1982 (now U.S. Pat. No. 4,489,706), by Paul W. Hait for Multi-Purpose Fuel Efficient Portable Stove/Heater and in U.S. application, Ser. No. 296,879, filed by Paul W. Hait on Aug. 27, 1981, for Multi-Purpose Fuel Efficient Portable Stove/-Heater, now abandoned. The cooking unit is particularly adapted to be used outdoors as an environmentally enclosed heating and cooking system.

Other cooking units are customarily used on patios for barbequing and the like. Such cooking units have provisions for disassembling or collapsing to promote easy storage. The arrangement of parts of a cooking unit that is used in outdoor cooking is considerably different than the arrangement of parts for cooking units used for patio cooking. Since many people who participate in outdoor camping activities may also enjoy the experience of patio cooking, there is a need for a convertible cooking unit that may be arranged in a compact form for ease in transporting and storage and is capable not only of being used in a camping atmosphere to perform the heating and cooking chores that are required around a campfire, but also of being used to carry out specialized cooking operations, such as hibachi cooking, that are associated with patio functions. Such a cooking unit has been disclosed in U.S. application filed by Paul W. Hait, Ser. No. 06/440,984, on Nov. 12, 1982, for Convertible Cooking Unit, now U.S. Pat. No. 4,508,094.

The assignee of the present application is the assignee of the aforementioned pending U.S. applications.

SUMMARY OF THE INVENTION

A cooking unit includes a truncated pyramidal firebox and a truncated pyramidal support member, which is disposed on the firebox to enable the cooking unit to perform various cooking procedures. An oven is disposed below the firebox or, in the alternative, the oven is disposed above the firebox and the support member to enhance the versatility of the cooking unit.

To improve the versatility of the cooking unit, an oven with a drawer is provided. The collapsed or folded truncated pyramidal firebox, the collapsed or folded truncated support member, a flat grill, a flat griddle, a flat diffuser, and a collapsed or folded windbreak are disposed above the oven and below the cover in compact form for storage and transporting. The cover is releasably secured to the top of the oven to retain the folded firebox, the folded support member, the flat grill, the flat griddle, the flat diffuser and folded windbreak between the oven and the cover in the compact form. In use, the extended truncated pyramidal firebox, the extended truncated pyramidal support and diffuser are disposed above the oven, whereby the oven is used as a base and for cooking. In the alternative, the cover serves as the base with the extended truncated pyramidal firebox and the extended truncated pyramidal support member disposed above the cover. A diffuser is disposed in the extended truncated pyramidal support member above the extended truncated pyramidal firebox. The oven is disposed above the truncated pyramidal support member.

DESCRIPTION OF A PREFERRED EMBODIMENT

Figure 1:
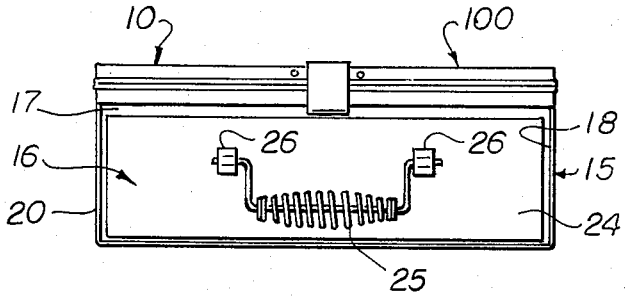
FIG. 1 is a front elevation view of the convertible cooking unit of the present invention shown in its compact transporting and storing mode.

Illustrated in FIGS. 1–4 is a convertible cooking unit 10 embodying the present invention in the compact mode for storage and transporting. Toward this end, the convertible cooking unit 10 comprises an oven 15 made, in the preferred embodiment, of stainless steel. The oven 15 includes a suitable stainless steel drawer 16. At the rear wall 17 of the oven 15 is a suitable opening 18. At the rear wall of the drawer 16 is a yieldable latch 19. When the latch 19 engages the rear wall 17 surrounding the opening 18, the drawer 16 is retained in the closed position within the oven 15. When the latch 19 is urged away from the rear wall 17 against its yieldable action, the drawer 16 is moved manually to an open position or a position extending forwardly of a front wall 20 of the oven 15.

On the front wall 24 of the drawer 16 of the oven 15 is a handle 25 which is swingably mounted on the front wall 24 by suitable ears 26. The ears 26 are attached to the front wall 24.

Figure 4:
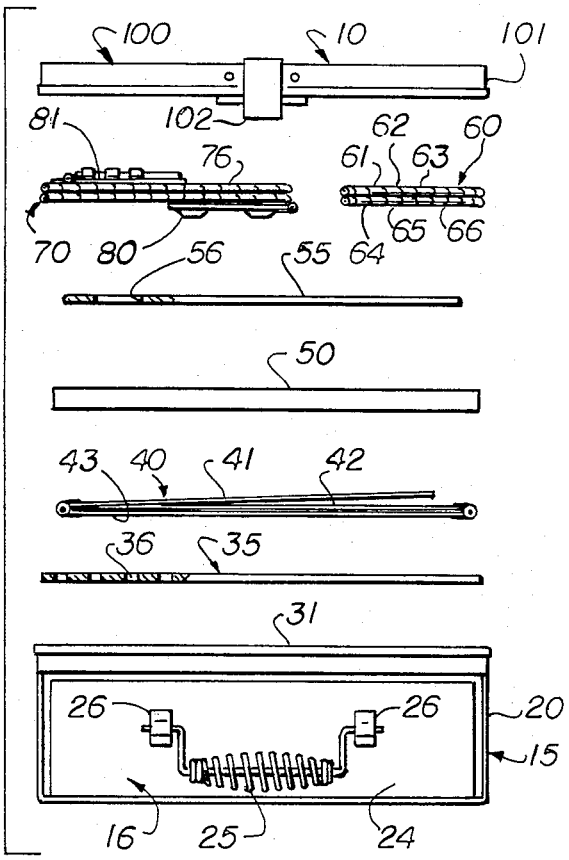
FIG. 4 is a diagrammatic exploded view of the convertible cooking unit shown in FIG. 1.

Upstanding from a top wall 30 of the oven 15 along the perimeter thereof are four upstanding flanges 31 in a quadrilateral relation. Disposed above the oven 15, when the convertible cooking unit 10 is in the compact mode, is a suitable large flat grill 35 (FIG. 4). The large grill 35 includes parallel longitudinal rows of openings 36 spaced equal distances apart in the transverse direction. The grill 35, in the preferred embodiment, is made of stainless steel.

Figure 17:
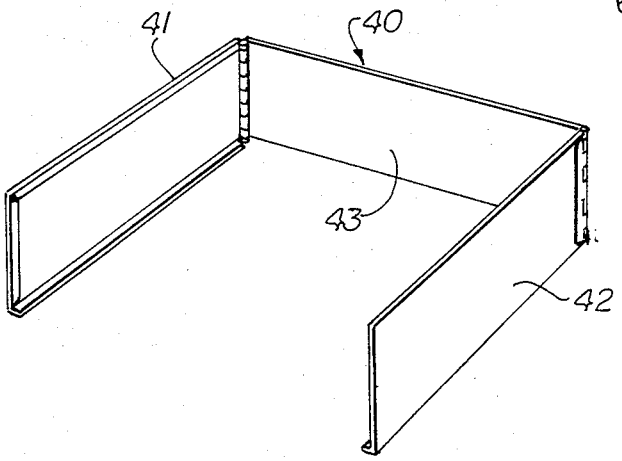
FIG. 17 is a diagrammatic perspective view of the windbreak employed in the convertible cooking unit of the present invention.

Above the large grill 35 is disposed a folded windbreak 40 made, in the preferred embodiment, of stainless steel. In the preferred embodiment, the windbreak 40 includes three panels 41–43 to form in the extended position upright panels 41–43 defining a rear and adjacent sides. The side panels 41 and 42 are hingedly attached to opposite ends of the rear panel 43 (FIG. 17). In wind blowing areas, the windbreak 40 reduces heat loss during the cooking operation. Toward this end, a blast of wind would have a lesser tendency to blow heat from the cooking surface that would generally be utilized for cooking purposes. The opening between the side panels 41 and 42 would generally face the direction in which the wind blows.

Disposed on the top of the windbreak 40 and an exposed section of the large grill is a griddle or sauce pan 50. The griddle 50 is a flat member of preferably stainless steel with upstanding flanges around the perimeter thereof to form a quadrilateral configuration. The griddle 50 can interchangeably be used in lieu of the large grill 35 for performing various cooking procedures.

A diffuser 55 is disposed on the griddle 50 and has a quadrilateral configuration. The diffuser 55 is a flat member made, in the preferred embodiment, of stainless steel with openings 56 formed in the vicinity of the sides thereof, but inwardly of the edges thereof. The openings 56 define a quadrilateral configuration. The diffuser 55 serves to distribute heat from a concentrated or localized source uniformly or evenly throughout a broader area or cooking surface, such as the griddle 50 or the large grill 35.

In the compact mode, a folded or collapsed truncated pyramidal support member 60 is disposed on one section of the diffuser 55. The truncated pyramidal support member 60 comprises, in the preferred embodiment, six stainless steel panels 61–66. Adjacent panels 61 and 62 are hinged together to form a truncated panel, when extended. Confronting adjacent panels 63 and 64 are hinged together and form a truncated panel when extended. Panels 65 and 66 are truncated panels formed with suitable openings for venting of heat and the conduction of air. The panel 65 is hinged at its opposite ends to panels 62 and 64, respectively. Similarly, the panel 66 is hinged at its opposite ends to panels 61 and 63, respectively. In the extended or unfolded condition for use during a cooking operation, the support member 60 assumes a truncated pyramidal configuration. To fold the support member 60 for the compact mode, the panels 61, 62 and 63, 64 are folded along their respective hinge connections inwardly (FIG. 3) for placement on a section of the diffuser 55.

The extended or unfolded truncated pyramidal support member not only supports a cooking surface, such as the griddle 50 or the large grill 35, but also conducts the heat so as to apply the heat over a broader cooking surface, such as the griddle 50 or the large grill 35.

Figure 6:
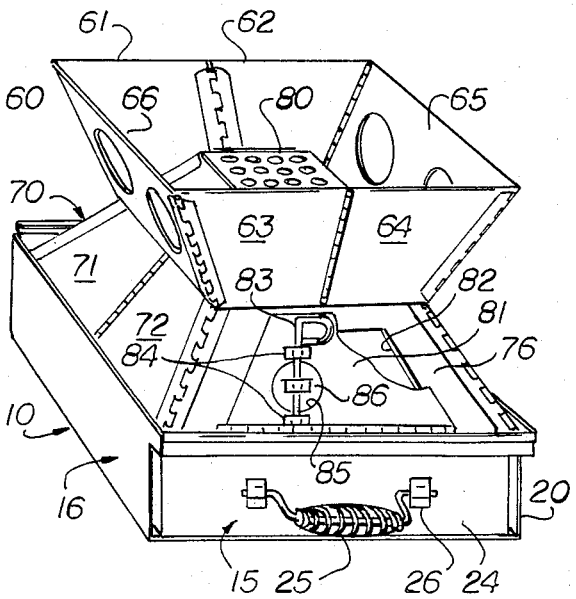
FIG. 6 is a diagrammatic perspective view of the convertible cooking unit of the present invention assembled for use as an oven with the oven serving as the base of the cooking unit.
Figure 7:
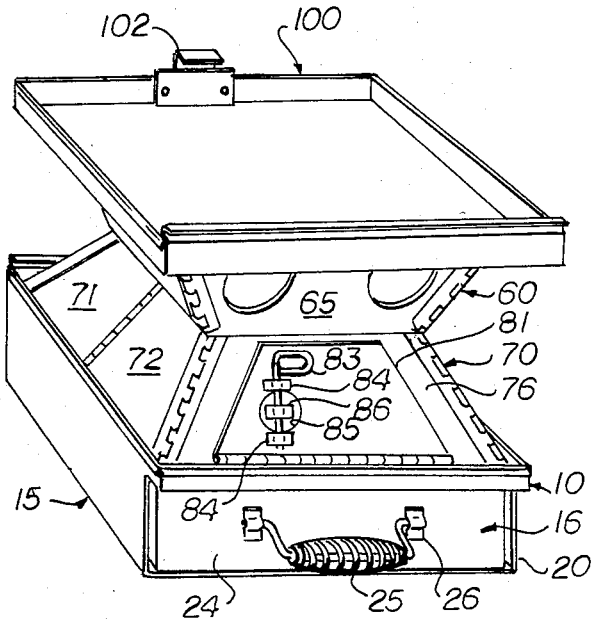
FIG. 7 is a diagrammatic perspective view of the convertible cooking unit of the present invention with the oven serving as the base of the cooking unit and with the cover supported by the extended truncated pyramidal support member to serve as a griddle.
Figure 8:
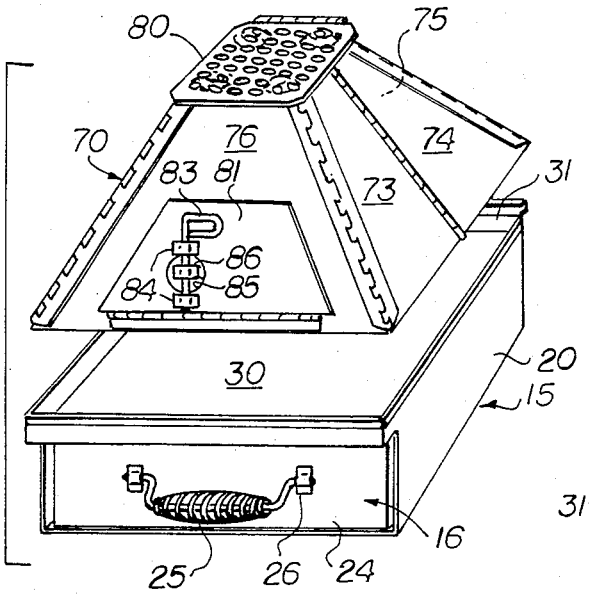
FIG. 8 is an exploded diagrammatic perspective view of the convertible cooking unit of the present invention with the oven serving as the base of the convertible cooking unit and with a small grill providing a cooking surface.
Figure 9:
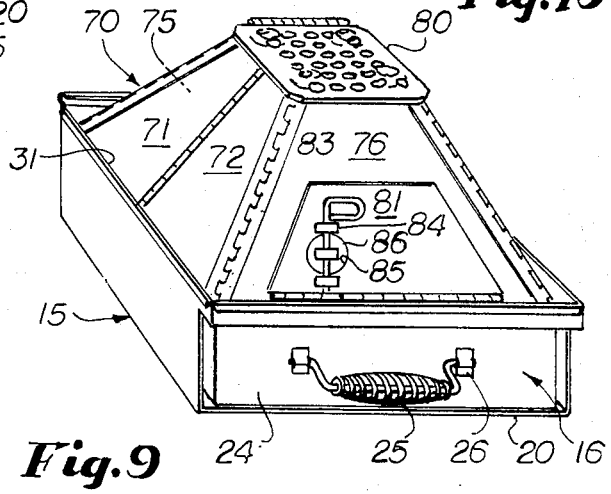
FIG. 9 is a diagrammatic perspective view of the convertible cooking unit shown in FIG. 8 in an operative condition.

A folded or collapsed truncated pyramidal firebox 70 is disposed on a section of the diffuser 55 for the storage and transport compact mode. There will be a slight overlapping relation between the folded truncated pyramidal firebox 70 and the folded truncated pyramidal support member 60 in the compact mode, in the exemplary embodiment. The truncated pyramidal firebox 70, in the preferred embodiment, is made of stainless steel and comprises panels 71–76 (FIG. 6). Adjacent panels 71 and 72 are hinged together to form a truncated panel when extended. Confronting adjacent panels 73 and 74 are hinged together to form a truncated panel, when extended. Panels 75 and 76 (FIG. 8) are truncated panels. The panel 75 is hinged at its opposite ends to panels 72 and 74, respectively. Similarly, the panel 76 is hinged at its opposite ends to panels 71 and 73, respectively. In the extended or unfolded condition, the firebox 70 assumes a truncated pyramidal configuration so as to be suitable for use during a cooking operation (FIGS. 6, 7). To fold the firebox 70 for the compact mode, the panels 71, 72 and 73, 74 are folded along their respective hinged connections inwardly (FIG. 3) for placement on a section of the diffuser 55.

Fuel is placed in the firebox 70 on the top wall 30 of the oven 15, when extended for cooking operations, to generate the heat for cooking operations (FIGS. 6, 7). The truncated pyramidal configuration of the firebox 70 serves to concentrate or converge the generated heat and to direct or focus the heat on a cooking surface. Hingedly attached to the panel 75 at the top thereof is a small grill 80. The small grill 80 when folded over the top of the firebox 70, when extended, forms a cooking surface. When pivoted away from the central opening through the extended firebox 70, the small grill 80 rests against the panel 75 to provide a greater access area for the circulation of heat and air through the extended firebox 70. Hingedly attached to the panel 76 at the bottom thereof is a damper or access door 81. The damper or access door 81, when disposed against the panel 76, covers an access opening 82 formed in the panel 76. For increasing the circulation of air through the opening 82, the damper 81 is pivoted about its horizontally disposed hinge away from the panel 76, thereby enabling the increase of flow of air through the opening 82 of the firebox 70. Fuel may be placed within the firebox 70 through the access opening 82.

A handle 83 is journalled for rotation on the damper 81 through ears 84. By gripping the handle 83, the damper 81 can be moved about the horizontally disposed hinge at the lower end of the panel 76. A cylindrical opening 85 is formed in the damper 81. Attached to the handle 83 for rotatable movement therewith is a disc 86. The disc serves to regulate the exposure of the opening 85 for controlling the circulation of air through the opening 85. Thus, the disc 86 also functions as a damper, when the damper 81 covers the access opening 82.

Figure 2:
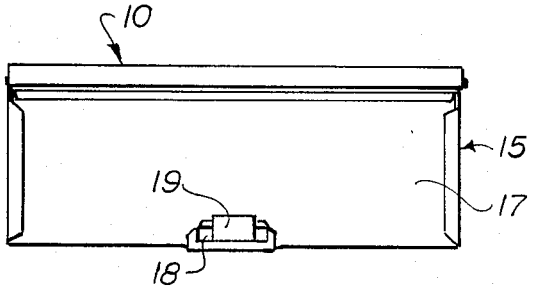
FIG. 2 is a rear elevation view of the convertible cooking unit shown in FIG. 1.

A cover 100 (FIG. 5) is disposed above the firebox 70 and the support member 60 during the compact mode. Depending flanges 101 (FIG. 4) form a quadrilateral configuration and extend outwardly and alongside the upstanding flanges 31 of the oven 15 during the compact mode. Fixed to the top wall of the cover 100 is a flexible latch 102 that has a lower angular member 103 to grip the front upstanding flange 31 of the oven 15 to releasably secure or lock the cover 100 to the oven 15. In this manner, a compact cooking unit 10 is provided for storage and for transportation (FIGS. 1 and 2). The rear depending flange 101 of the cover 100 includes a lip or channel shaped member along its lower edge. The lip or channel shaped member is retained in a channel shaped edge along the rear upstanding flange 31 of the oven 15. In this manner, the rear of the cover 100 is releasably secured and pivotally connected to the rear of the oven 15.

Figure 3:
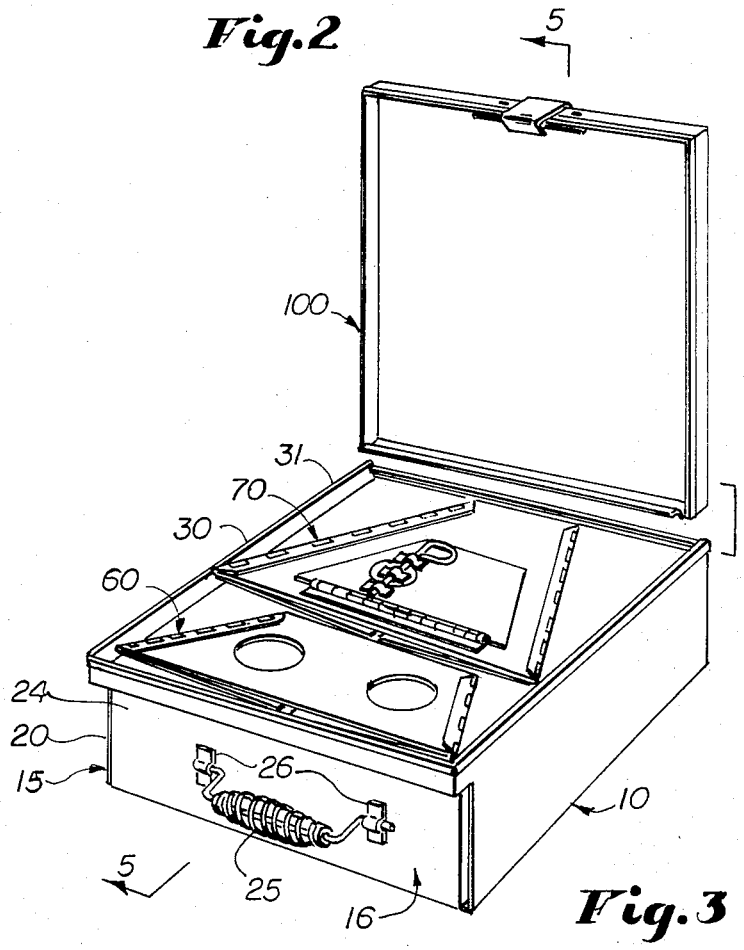
FIG. 3 is a diagrammatic perspective view of the convertible cooking unit shown in FIG. 1 with the cover thereof pivoted to the open position.
Figure 5:
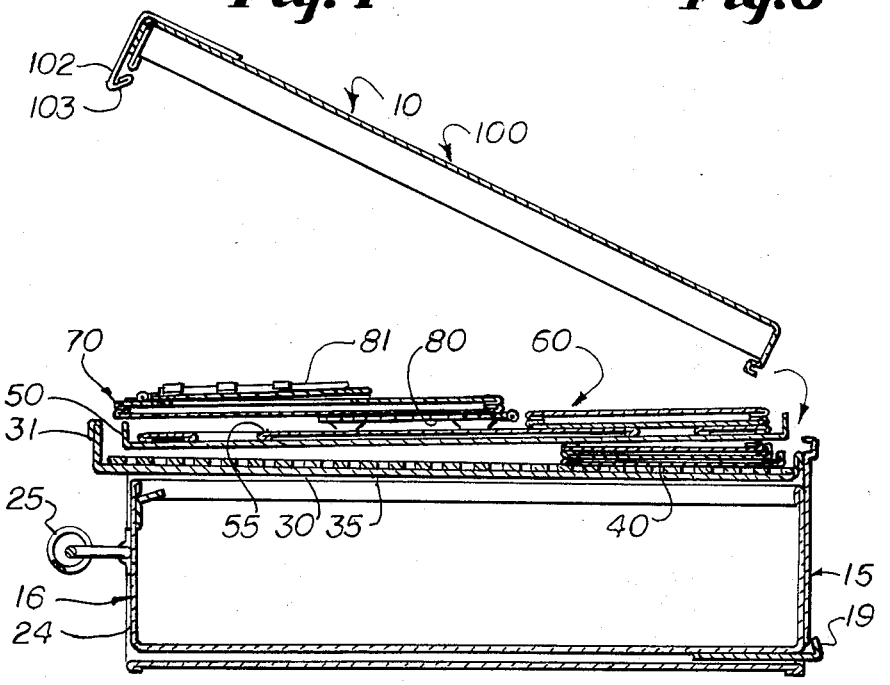
FIG. 5 is a vertical sectional view taken along line 5—5 of FIG. 3.

To assemble the convertible cooking unit 10 for a cooking operation, the free end of the flexible latch 102 is moved away from the upstanding front flange 31 of the oven 15 to free itself from locking engagement therewith. The cover 100 is lifted in pivotal manner about the lip on the rear depending flange 101 thereof (FIG. 3). The cover 100 is now moved forwardly to release the lip at the rear thereof from the oven 15. To secure the cover 100 to the oven 15, the lip at the rear thereof is placed in the channel shaped edge along the rear upstanding flange 31 of the oven 15 to be retained therein (FIG. 5). The cover 100 is pivoted downwardly about the rear lip thereof until the latch 102 grips the upstanding front flange 31 of the oven 15 to be retained thereby. When the flanges 101 extend downwardly, the cover 100 may be used as a flat griddle. When the flanges 101 extend upwardly, the cover 100 may be employed as a sauce pan.

In the use of the convertible cooking unit 10 for various cooking procedures, reference is made to FIGS. 6–16. The oven 15 forms the base of the convertible cooking unit 10 in FIGS. 8 and 9. The firebox 70 is unfolded or extended and is disposed on the top wall 30 of the oven 15 between the upstanding flanges 31 thereof. The small grill 80 is pivoted to cover the central opening through the truncated pyramidal firebox 70. Fuel is placed in the firebox 70 on top of the top wall 30 of the oven 15 to generate the heat for cooking.

Figure 10:
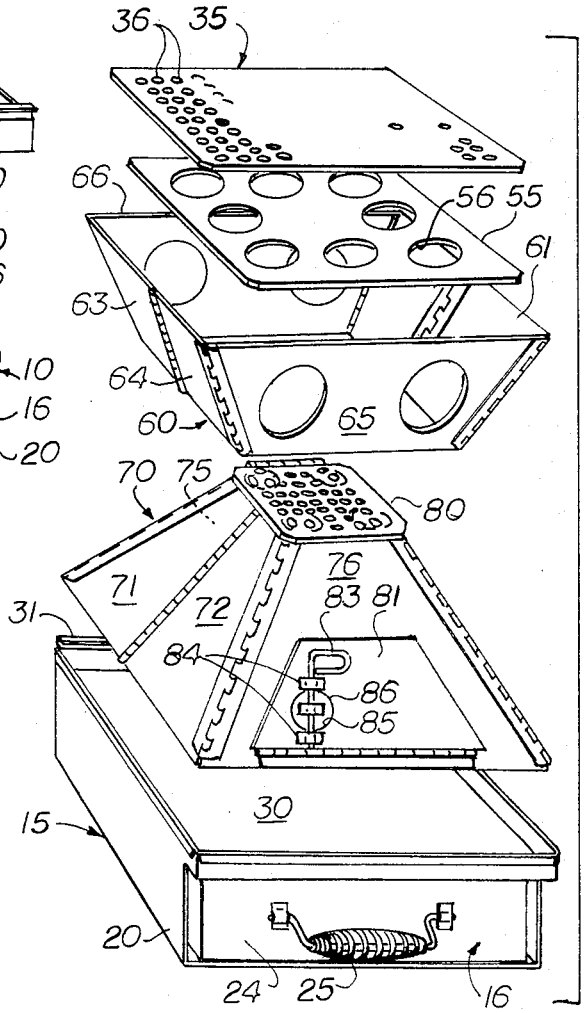
FIG. 10 is an exploded diagrammatic perspective view of the convertible cooking unit of the present invention with the oven serving as the base of the convertible cooking unit and a large grill providing a cooking surface.
Figure 11:
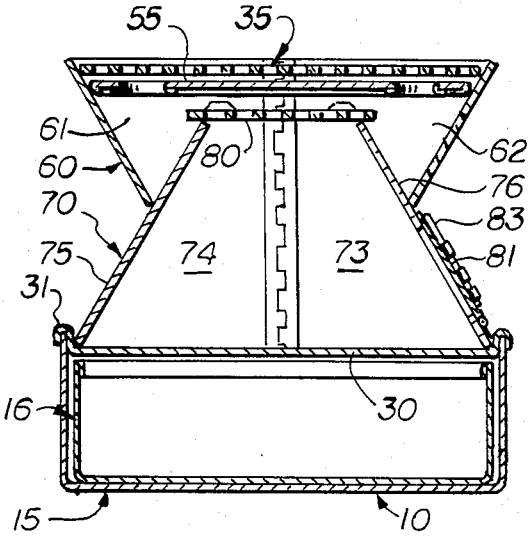
FIG. 11 is a diagrammatic vertical sectional view of the convertible cooking unit shown in FIG. 10 when it is assembled with the oven forming the base of the convertible cooking unit and with the large grill providing a cooking surface.

The convertible cooking unit, as illustrated in FIGS. 6, 10 and 11, provides for the oven 15 and the large grill 35. Again, the oven 15 forms the base of the convertible cooking unit 10. As previously described, the firebox 70 is unfolded or extended and is disposed on the top wall 30 of the oven 15 between the upstanding flanges 31 thereof. The small grill 80 is again pivoted to cover the central opening of the truncated pyramidal firebox 70. At this time, the support member 60 is unfolded or extended to assume a truncated pyramidal configuration. The truncated pyramidal support member 60 is placed on the firebox 70 with the narrow opening thereof at the bottom thereof. The extended firebox 70 and the extended support member 60 are aligned axially with the narrow end of the firebox 70 received by the narrow end of the support member 60. Thus, the pyramidal support member 60 is inverted with respect to the pyramidal firebox 70. The diffuser 55 is now disposed in the truncated pyramidal support member 60 and is horizontally disposed. The large grill 35 is disposed on the truncated pyramidal support member 60.

Figure 12:
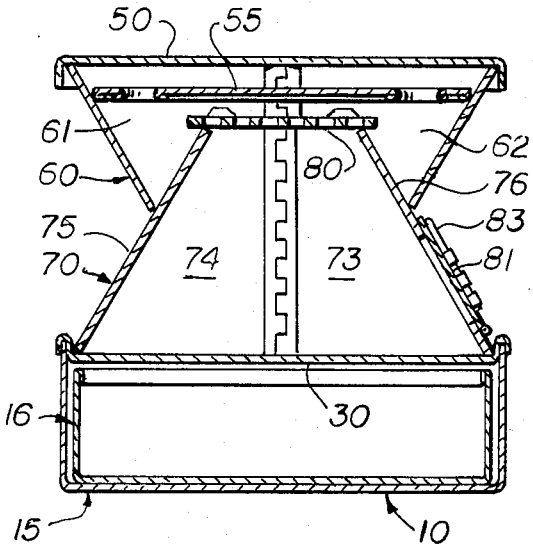
FIG. 12 is a diagrammatic vertical sectional view of the convertible cooking unit similar to FIG. 11 but showing the cover providing a griddle cooking surface instead of the large grill providing a cooking surface.

In the alternative, the griddle 50 can be used in lieu of the large grill 35 (FIG. 12). If desired, the cover 100 may be employed as a griddle and used in lieu of the griddle 50 (FIG. 7).

Figure 13:
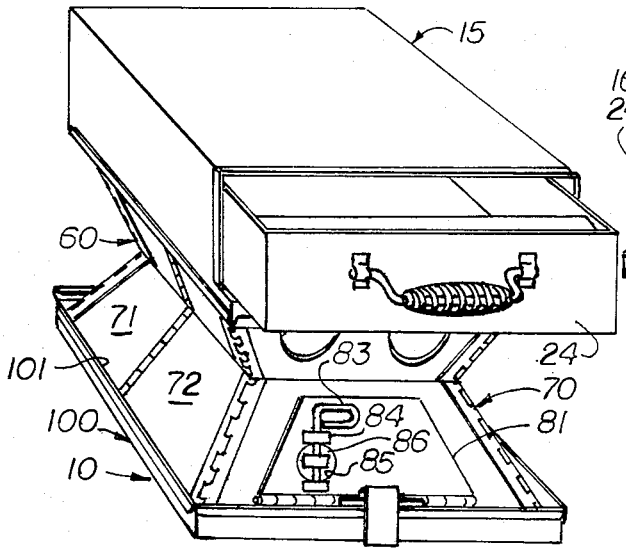
FIG. 13 is a diagrammatic perspective view of the convertible cooking unit of the present invention with the cover serving as the base of the unit and with the oven disposed above the extended truncated pyramidal support member.
Figure 14:
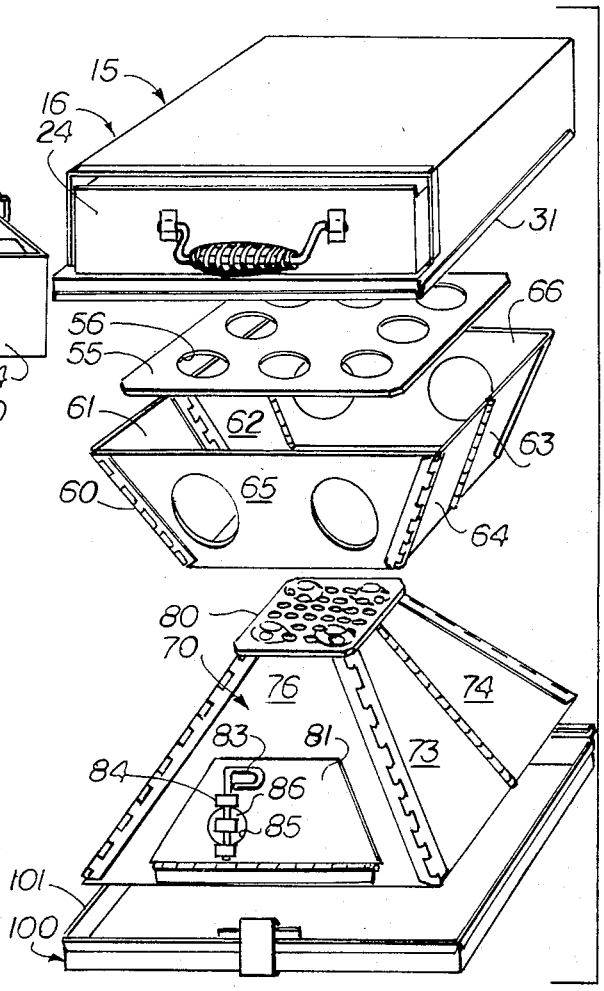
FIG. 14 is an exploded diagrammatic perspective view of the convertible cooking unit of the present invention with the cover of the cooking unit serving as the base of the unit and with the oven disposed above the extended truncated pyramidal support member.
Figure 15:
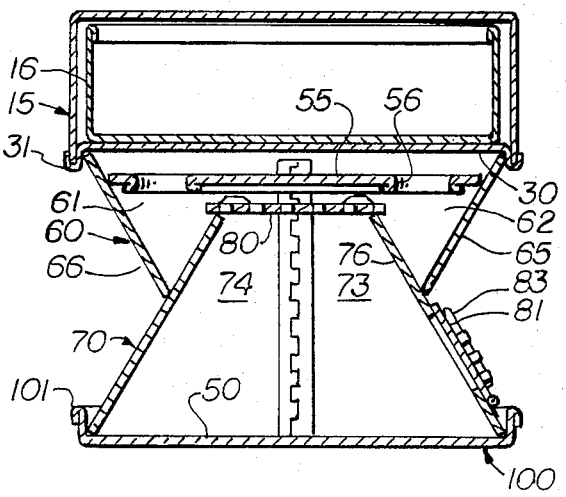
FIG. 15 is a vertical cross sectional view taken through the convertible cooking unit of FIG. 14 when it is assembled.

In FIGS. 13–15, the convertible cooking unit 10 provides for the oven 15, to be disposed at the top of the cooking unit 10. The cover 100 is employed as the base of the cooking unit 10. Hence, the flanges 101 of the cover 100 are now upstanding. The firebox 70 is disposed on the cover 100 within the upstanding flanges 101 thereof. In turn, the truncated pyramidal support member 60 is placed on the firebox 70 with the narrow end thereof receiving the firebox 70. Disposed within the truncated pyramidal support member 60 is the diffuser 55. Now, the drawer 16 is removed from the oven 15. The oven 15 is disposed on the truncated pyramidal support member 60 with the flanges 101 thereof depending and surrounding the top of the panels 61–66 of the support member 60. The drawer 16 is reinserted into the oven 15.

Figure 16:
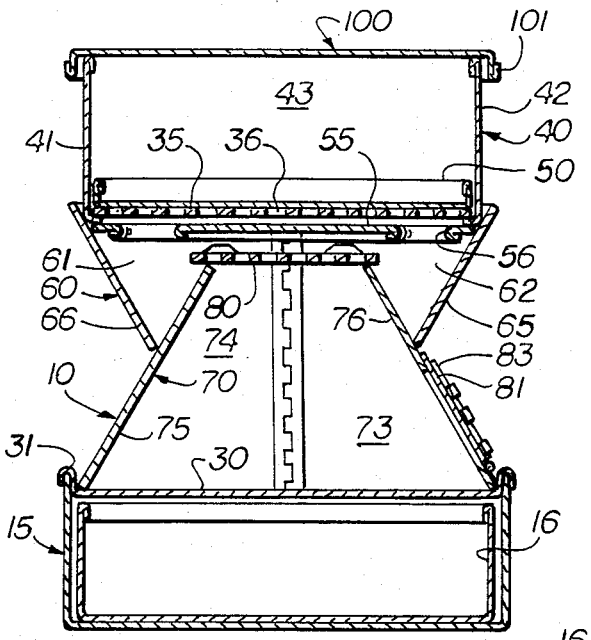
FIG. 16 is a vertical cross sectional view of the convertible cooking unit of the present invention in the assembled condition with the oven forming the base thereof and with a windbreak disposed on the truncated support member and with the cover supported by the windbreak.

The cooking unit 10 as illustrated in FIG. 16 is similar to the cooking unit 10 illustrated in FIG. 12. In FIG. 16, the windbreak 40 is employed to conserve the heat applied to the cooking surface, such as the griddle 50. For added protection against weather elements, the cover 100 can be disposed on the windbreak 40 to provide an overhead horizontal protecting wall.

We claim:

1. A cooking unit comprising an open-ended support member of truncated pyramidal configuration, said support member having a smaller end, an open-ended firebox of truncated pyramidal configuration disposed below and in axial alignment with said support member, said firebox having a smaller end, said smaller end of said firebox projecting through the opening in the smaller end of said support member, oven means defining an enclosed cooking chamber disposed at times below said firebox to support said firebox and at other times disposed above said support member to be supported by said support member, said oven means providing a base for said cooking unit when disposed below said firebox, a cover disposed below said firebox to provide a base for said cooking unit when said oven means is disposed above said support member, said oven means comprising a planar top wall having upstanding flanges along the perimeter thereof, said cover comprising depending flanges along the perimeter thereof cooperating with said upstanding flanges of said top wall of said oven means to define an enclosed space, said firebox being collapsible to a relatively flat form and positionable in said space, said support member being collapsible to a relatively flat form and positionable in said space, said firebox when in a collapsed state and said support member when in a collapsed state being disposed generally parallel to the top wall of said oven means when positioned in said space, and means for locking said cover over said oven means when said firebox in a collapsed state and said support member in a collapsed state are positioned in said space.

2. A cooking unit comprising an open-ended support member of an inverted truncated pyramidal configuration having a smaller lower end, an open-ended firebox of truncated pyramidal configuration disposed below and in axial alignment with said support member, said firebox having a smaller upper end projecting through the opening in the smaller lower end of said support member, a grill pivotally connected to the smaller end of said firebox to be movable from a position over the smaller end of said firebox to a position along a side of said firebox exteriorly thereof, said firebox being formed with an access opening along a side thereof, said firebox comprising an access door pivotally connected to said side of said firebox from a position covering said access opening to a position exposing said access opening, said access door comprising a cylindrical opening formed therein, said access door comprising a disc rotatably mounted thereon, said access door comprising a handle for moving said disc from a closure position in said cylindrical opening to a position opening said cylindrical opening, an oven disposed below said firebox for supporting said firebox, said oven defining a cooking chamber heated by said firebox, food support means disposed over the upper end of said support member, a diffuser disposed in said support member, a windbreak disposed on said food support means, said oven comprises a planar top wall having upstanding flanges along the perimeter thereof, said cooking unit comprising a cover having depending flanges along the perimeter thereof cooperating with the side flanges of said top wall of said oven to define an enclosed space, said firebox with said grill and said access door pivotally connected thereto being collapsible to a relatively flat form and positionable in said space, said support member being collapsible to a relatively flat form and positionable in said space, said food support means being flat and positionable in said space, said diffuser being flat and positionable in said space, said windbreak being collapsible to a relatively flat form and positionable in said space, said collapsible firebox when in a collapsed state, said collapsible support member when in a collapsed state, said food support means, said diffuser and said collapsible windbreak when in a collapsed state being disposed generally parallel to the top wall of said oven, and means for locking said cover over said oven when said collapsible firebox, said collapsible support member, said food support means, said diffuser and said collapsible windbreak are positioned in said space.

3. A cooking unit comprising an open-ended support member of an inverted truncated pyramidal configuration, said support member having a smaller end, an open-ended firebox of truncated pyramidal configuration disposed below and in axial alignment with said support member, said firebox having a smaller end, said smaller end of said firebox projecting through the opening in the smaller end of said support member, and oven means defining an enclosed cooking chamber disposed at times below said firebox to support said firebox and at other times disposed above said support member to be supported by said support member, said firebox comprising panels having trapezoidal configurations and adjacent, non-parallel edges of said panels being hingedly connected for folding and extending said firebox, said support member comprising panels having trapezoidal configurations and adjacent, non-parallel edges of said panels of said support member being hingedly connected for folding and extending said support member.

4. A cooking unit as claimed in claim 3 wherein each panel of a confronting pair of panels of said firebox comprises adjacent plates hingedly connected for folding said firebox into a generally flat configuration, and wherein each panel of a confronting pair of panels of said support member comprises adjacent plates hingedly connected for folding said support member into a generally flat configuration.

5. A cooking unit comprising a firebox of truncated pyramidal configuration, said firebox having a smaller end, a support member of truncated pyramidal configuration having an opening in its smaller end, said support member having a smaller end, said support member being disposed in inverted position over said firebox with the smaller end of said firebox projecting through the opening at the smaller end of said support member, said support member cooperating with said firebox to direct heat radiating from said firebox thereabove for cooking, and an oven disposed below said firebox for supporting said firebox, said oven being heated by heat radiating from said firebox, said firebox comprising panels having trapezoidal configurations and adjacent, non-parallel edges of said panels being hingedly connected for folding and extending said firebox, said support member comprising panels having trapezoidal configurations and adjacent, non-parallel edges of said panels of said support member being hingedly connected for folding and extending said support member.

6. A cooking unit as claimed in claim 5 wherein each panel of a confronting pair of panels of said firebox comprises adjacent plates hingedly connected for folding said firebox into a generally flat configuration, and wherein each panel of a confronting pair of panels of said support member comprises adjacent plates hingedly connected for folding said support member into a generally flat configuration.

7. A cooking unit comprising an open-ended support member of an inverted truncated pyramidal configuration having a smaller lower end, an open-ended firebox of truncated pyramidal configuration disposed below and in axial alignment with said support member, said firebox having a smaller upper end projecting through the opening in the smaller lower end of said support member, and a grill pivotally connected to the smaller end of said firebox to be movable from a position over the smaller end of said firebox to a position along a side of said firebox exteriorly thereof, said firebox comprising panels having trapezoidal configurations and adjacent, non-parallel edges of said panels being hingedly connected for folding and extending said firebox, said support member comprising panels having trapezoidal configurations and adjacent, non-parallel edges of said panels of said support member being hingedly connected for folding and extending said support member.

8. A cooking unit as claimed in claim 7 wherein each panel of a confronting pair of panels of said firebox comprises adjacent plates hingedly connected for folding said firebox into a generally flat configuration, and wherein each panel of a confronting pair of panels of said support member comprises adjacent plates hingedly connected for folding said support member into a generally flat configuration.

9. A cooking unit comprising:

(a) a first hollow open-ended member having a truncated pyramidal configuration, and having a smaller open end, said first member comprising a plurality of first panels, each of said first panels having a trapezoidal configuration;

(b) a second hollow open-ended member having an inverted truncated pyramidal configuration and having a smaller open end, said second member comprising a plurality of second panels, each of said second panels having a trapezoidal configuration, said second member being disposed above said first member and in axial alignment therewith, said smaller open ends of said first member and said second member being disposed in telescoping relation;

(c) first hinge means hingedly connecting adjacent non-parallel edges of said first panels of said first member for folding and extending said first member;

(d) second hinge means hingedly connecting adjacent non-parallel edges of said second panels of said second member for folding and extending said second member; and (e) an oven disposed below said first member on which said first member is supported.

10. A cooking unit as claimed in claim 9 wherein each panel of a confronting pair of first panels of said first member comprises adjacent plates hingedly connected for folding said first member into a generally flat configuration, and wherein each panel of a confronting pair of panels of said second member comprises adjacent plates hingedly connected for folding said second member into a generally flat configuration.

11. A cooking unit comprising:

(a) a first hollow open-ended member having a truncated pyramidal configuration, and having a smaller open end, said first member comprising a plurality of first panels, each of said first panels having a trapezoidal configuration;

(b) a second hollow open-ended member having an inverted truncated pyramidal configuration and having a smaller open end, said second member comprising a plurality of second panels, each of said second panels having a trapezoidal configuration, said second member being disposed above said first member and in axial alignment therewith, said smaller open ends of said first member and said second member being disposed in telescoping relation;

(c) first hinge means hingedly connecting adjacent non-parallel edges of said first panels of said first member for folding and extending said first member;

(d) second hinge means hingedly connecting adjacent non-parallel edges of said second panels of said second member for folding and extending said second member; and (e) an oven seated on said second member.

12. A cooking unit as claimed in claim 11 wherein each panel of a confronting pair of first panels of said first member comprises adjacent plates hingedly connected for folding said first member into a generally flat configuration, and wherein each panel of a confronting pair of panels of said second member comprises adjacent plates hingedly connected for folding said second member into a generally flat configuration.

13. A cooking unit as claimed in claim 10 and comprising an oven comprising a planar top wall with upstanding side flanges on which top wall of said first member is disposed, a cover positionable over said oven and having side flanges cooperating with the side flanges of said oven to define an enclosed space when said cooking unit is in a collapsed state for transporting and storing, said first member and said second member being folded, respectively, to a generally flat form and disposed in said enclosed space generally parallel to the plane of said top wall when said cover is positioned over said oven to define the enclosed space, and means locking said cover to said oven when said folded first member and said folded second member are disposed in said enclosed space.

14. A cooking unit as claimed in claim 10 and comprising a grill pivotally connected to the smaller end of one of said hollow open-ended members to be movable from a position over the smaller end of said one hollow open-ended member to a position along a side of said one hollow open-ended member exteriorly thereof.

15. A cooking unit as claimed in claim 12 and comprising a grill pivotally connected to the smaller end of one of said hollow open-ended members to be movable from a position over the smaller end of said one hollow open-ended member to a position along a side of said one hollow open-ended member exteriorly thereof.

* * * * *